US011391485B2

(12) United States Patent
Kojima

(10) Patent No.: US 11,391,485 B2
(45) Date of Patent: Jul. 19, 2022

(54) AIR CONDITIONER INTERFACE

(71) Applicant: Mitsubishi Electric Corporation, Tokyo (JP)

(72) Inventor: Yoshihisa Kojima, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 96 days.

(21) Appl. No.: 17/051,601

(22) PCT Filed: Aug. 16, 2018

(86) PCT No.: PCT/JP2018/030431
§ 371 (c)(1),
(2) Date: Oct. 29, 2020

(87) PCT Pub. No.: WO2020/035928
PCT Pub. Date: Feb. 20, 2020

(65) Prior Publication Data
US 2021/0239349 A1 Aug. 5, 2021

(51) Int. Cl.
*F24F 11/67* (2018.01)
*F24F 11/52* (2018.01)
(Continued)

(52) U.S. Cl.
CPC ..... *F24F 11/67* (2018.01); *F24F 11/50* (2018.01); *F24F 11/52* (2018.01); *F24F 11/56* (2018.01); *F24F 11/65* (2018.01); *F24F 2110/10* (2018.01)

(58) Field of Classification Search
CPC .. F24F 11/30; F24F 11/52; F24F 11/56; F24F 11/65; F24F 11/67; F24F 11/77;
(Continued)

(56) References Cited

U.S. PATENT DOCUMENTS 7,664,575 B2 * 2/2010 Boydstun ..... G05B 9/02 454/238
7,802,618 B2 * 9/2010 Simon ..... G05D 23/1934 236/1 C
(Continued)

FOREIGN PATENT DOCUMENTS

JP H09-196440 A 7/1997
JP 2001-108285 A 4/2001
(Continued)

OTHER PUBLICATIONS

International Search Report of the International Searching Authority dated Oct. 30, 2018 for the corresponding International application No. PCT/JP2018/030431 (and English translation).

*Primary Examiner* — Crystal J Barnes-Bullock
(74) *Attorney, Agent, or Firm* — Posz Law Group, PLC

(57) ABSTRACT

An air conditioner interface is an interface to which an air conditioner, a manipulation terminal, and an external device are connected, the manipulation terminal being used by a user to manipulate the air conditioner, the external device having an air-conditioning function. The air conditioner interface includes a control unit that controls operation of the air conditioner and operation of the external device in accordance with an operating mode that is set to either a first operating mode to solely operate the air conditioner or a second operating mode to enable the air conditioner and the external device to operate simultaneously.

3 Claims, 7 Drawing Sheets

(51) Int. Cl.

| | |
|---|---|
| ***F24F 11/56*** | (2018.01) |
| ***F24F 11/65*** | (2018.01) |
| ***F24F 11/50*** | (2018.01) |
| *F24F 110/10* | (2018.01) |

(58) Field of Classification Search
CPC ..... F24F 2110/10; F24F 2120/10; F24F 2120/20; F24F 2221/34; G05D 23/1934
See application file for complete search history.

(56) References Cited

U.S. PATENT DOCUMENTS

| | | | | |
|---|---|---|---|---|
| 8,112,181 | B2 * | 2/2012 | Remsburg | F24F 11/30 700/277 |
| 8,774,947 | B2 * | 7/2014 | Sartain | F24F 11/00 700/83 |
| 9,599,382 | B2 * | 3/2017 | Higaki | G05D 23/1905 |
| 9,784,461 | B2 * | 10/2017 | Billman | F24F 11/30 |
| 10,088,192 | B2 * | 10/2018 | Crimins | G05D 23/1904 |
| 10,190,788 | B2 * | 1/2019 | Schnell | F24F 11/62 |
| 2017/0010014 | A1 * | 1/2017 | Miyata | G05B 15/02 |
| 2018/0363933 | A1 * | 12/2018 | Ross | F24F 11/77 |
| 2020/0340704 | A1 * | 10/2020 | Ross | F24F 11/30 |
| 2021/0156585 | A1 * | 5/2021 | Kido | F24F 11/48 |
| 2021/0381714 | A1 * | 12/2021 | Hei | F24F 11/58 |

FOREIGN PATENT DOCUMENTS

| | | | |
|---|---|---|---|
| JP | 2013-194924 | A | 9/2013 |
| JP | 2017-166754 | A | 9/2017 |
| JP | 2017-208741 | A | 11/2017 |

* cited by examiner

| FIRST DIP SWITCH | SECOND DIP SWITCH | OPERATING MODE | TARGET OPERATING DEVICE | |
|---|---|---|---|---|
| | | | COOLING/DRYING/ AIR-BLOWING | HEATING |
| OFF | OFF | NORMAL OPERATION | AIR CONDITIONER | |
| ON | OFF | FIRST SPECIAL OPERATION | AIR CONDITIONER | EXTERNAL DEVICE |
| OFF | ON | SECOND SPECIAL OPERATION | AIR CONDITIONER | AIR CONDITIONER+ EXTERNAL DEVICE |

AIR CONDITIONER INTERFACE

CROSS REFERENCE TO RELATED APPLICATION

This application is a U.S. national stage application of International Patent Application No. PCT/JP2018/030431 filed on Aug. 16, 2018, the disclosure of which is incorporated herein by reference.

TECHNICAL FIELD

The present invention relates to an air conditioner interface that controls operation of an air conditioner and operation of an external device having an air-conditioning function.

BACKGROUND

There is proposed a conventional technique in which an air conditioner and an external device having an air-conditioning function are operated in conjunction with each other. For example, Patent Literature 1 discloses the technique for operating an air conditioner and a floor heater in conjunction with each other.

PATENT LITERATURE

Patent Literature 1: Japanese Patent Application Laid-open No. H9-196440

However, in the conventional technique, in order to make it possible for the air conditioner and the external device having an air-conditioning function to operate in conjunction with each other, both the air conditioner and the external device need to have means for being able to directly communicate with their counterpart. There has been a demand for the technique for making it possible for the air conditioner and the external device to operate in conjunction with each other even though both the air conditioner and the external device do not have means for being able to directly communicate with their counterpart.

SUMMARY

The present invention has been achieved to solve the above problems, and an object of the present invention is to provide an air conditioner interface that makes it possible for an air conditioner and an external device having an air-conditioning function to operate in conjunction with each other even though both the air conditioner and the external device do not have means for being able to directly communicate with their counterpart.

In order to solve the above-mentioned problems and achieve the object, an air conditioner interface according to the present invention is an interface to which an air conditioner, a manipulation terminal, and an external device are connected, the manipulation terminal being used by a user to manipulate the air conditioner, the external device having an air-conditioning function. The air conditioner interface includes a controlling circuitry that controls operation of the air conditioner and operation of the external device in accordance with an operating mode that is set to either a first operating mode to solely operate the air conditioner or a second operating mode to enable the air conditioner and the external device to operate simultaneously. When the second operating mode is set, the controlling circuitry determines a target operating device from among the air conditioner and the external device in accordance with a running mode for air conditioning instructed from the manipulation terminal, and then operates the target operating device determined. The running mode is any one of a cooling mode, a drying mode, an air-blowing mode, and a heating mode.

The air conditioner interface according to the present invention has an effect where it is possible for an air conditioner and an external device having an air-conditioning function to operate in conjunction with each other even though both the air conditioner and the external device do not have means for being able to directly communicate with their counterpart.

DETAILED DESCRIPTION

An air conditioner interface according to an embodiment of the present invention will be described in detail below with reference to the accompanying drawings. The present invention is not limited to the embodiment.

Embodiment

Figures 1, 2:
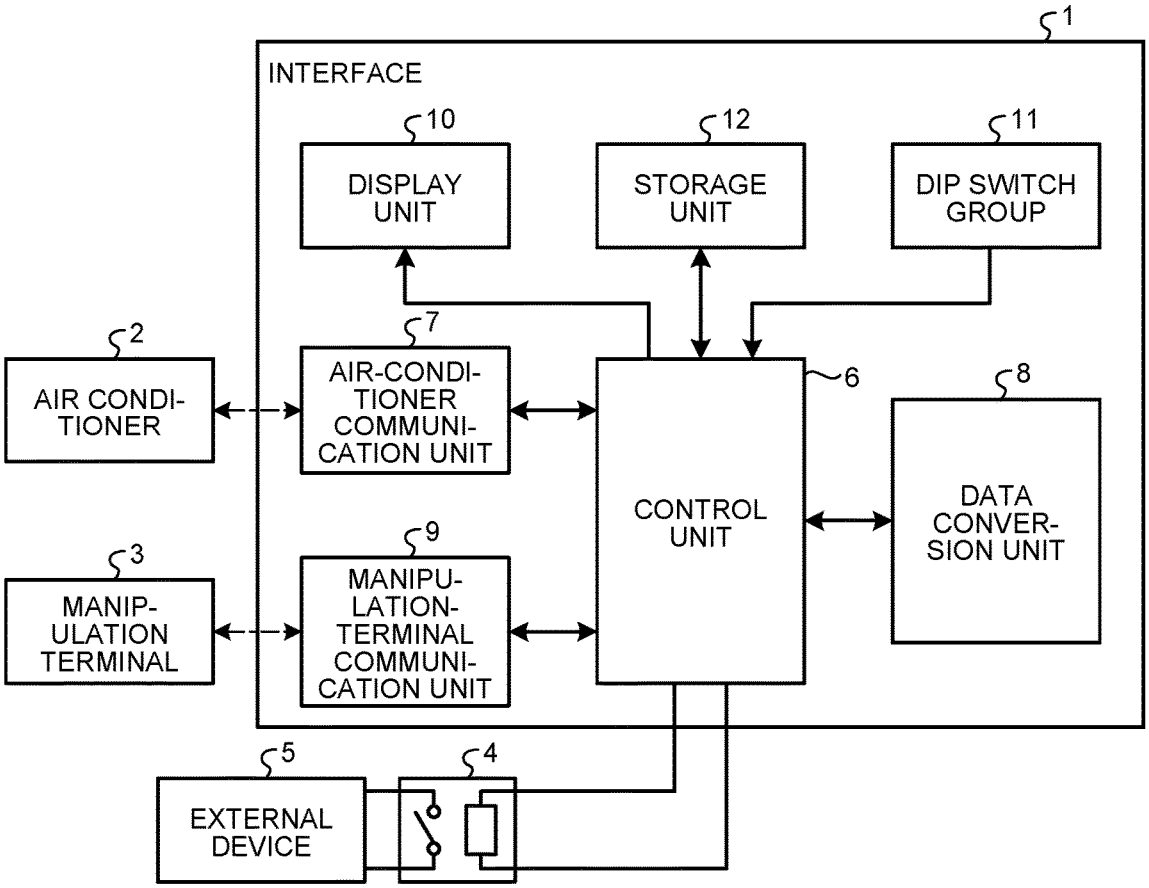
FIG. 1 is a diagram illustrating a configuration of an air conditioner interface according to an embodiment.
FIG. 2 is an explanatory diagram of an operating mode given to a DIP switch group included in the air conditioner interface according to the embodiment.

FIG. 1 is a diagram illustrating a configuration of an air conditioner interface 1 according to the embodiment. In the following descriptions, the "air conditioner interface 1" is sometimes described simply as "interface 1". An air conditioner 2 and a manipulation terminal 3 are connected to the interface 1. FIG. 1 also illustrates the air conditioner 2 and the manipulation terminal 3. The manipulation terminal 3 is a device to be used by a user to manipulate the air conditioner 2. A relay 4 is connected to the interface 1. An external device 5 having an air-conditioning function is connected to the relay 4. FIG. 1 also illustrates the relay 4 and the external device 5. The external device 5 is also connected to the interface 1 through the relay 4. For example, the external device 5 is a heater. In the following descriptions, the external device 5 is assumed to be a heater.

The interface 1 includes a control unit 6 that controls operation of the air conditioner 2 and operation of the external device 5. Specifically, the control unit 6 controls operation of the air conditioner 2 and operation of the external device 5 in accordance with an operating mode that is set to either a first operating mode to solely operate the air conditioner 2 or a second operating mode to enable the air conditioner 2 and the external device 5 to operate simultaneously. The first operating mode or the second operating mode is set for the interface 1.

When the second operating mode is set for the interface 1, the control unit 6 determines a target operating device from among the air conditioner 2 and the external device 5 in accordance with a running mode for air conditioning instructed from the manipulation terminal 3. The control unit 6 then operates the determined target operating device. When the control unit 6 determines a target operating device, and when the running mode is an automatic mode, the control unit 6 determines either one of a cooling mode and a heating mode as the running mode on the basis of a relation between a set temperature and a room temperature that is the temperature inside the room where the air conditioner 2 is installed, and then the control unit 6 determines the target operating device in accordance with the determined mode. The set temperature is set for the interface 1 through the manipulation terminal 3.

The interface 1 further includes an air-conditioner communication unit 7 that communicates with the air conditioner 2. The air-conditioner communication unit 7 receives information from the air conditioner 2. The interface 1 further includes a data conversion unit 8 that converts information received by the air-conditioner communication unit 7 to information corresponding to the automatic mode when the air conditioner 2 is not a device that supports the automatic mode. The interface 1 further includes a manipulation-terminal communication unit 9 that communicates with the manipulation terminal 3. Under control of the control unit 6, the manipulation-terminal communication unit 9 transmits information obtained by the data conversion unit 8 to the manipulation terminal 3.

The interface 1 further includes a display unit 10 that displays a communication state of the interface 1 with the air conditioner 2 and the manipulation terminal 3. For example, the display unit 10 is a light emitting diode. The interface 1 further includes a DIP switch group 11 to which the first operating mode or the second operating mode is given by a user. The interface 1 further includes a storage unit 12 that stores therein information indicating an operating mode given by a user, that is either the first operating mode or the second operating mode. The storage unit 12 also stores therein information indicating a set temperature that is set through the manipulation terminal 3. For example, the storage unit 12 is an electrically erasable programmable read only memory (EEPROM (registered trademark).

The control unit 6 has a function of controlling the air-conditioner communication unit 7, the data conversion unit 8, the manipulation-terminal communication unit 9, the display unit 10, and the storage unit 12. The control unit 6 has a function of inputting data to and outputting data from each of the air-conditioner communication unit 7, the data conversion unit 8, the manipulation-terminal communication unit 9, the display unit 10, and the storage unit 12. The control unit 6 has a function of obtaining information from the DIP switch group 11, the information indicating the operating mode given to the DIP switch group 11. The air-conditioner communication unit 7, the data conversion unit 8, the manipulation-terminal communication unit 9, the display unit 10, the DIP switch group 11, and the storage unit 12 are connected to the control unit 6.

When the interface 1 is activated, the control unit 6 reads information from the DIP switch group 11, the information indicating the operating mode given to the DIP switch group 11. The interface 1 is activated when the interface 1 is powered-on. The control unit 6 operates on the basis of the read information.

FIG. 2 is an explanatory diagram of an operating mode given to the DIP switch group 11 included in the air conditioner interface 1 according to the embodiment. The DIP switch group 11 is assumed to include a first DIP switch and a second DIP switch. Each of the first DIP switch and the second DIP switch enters either an on-state or an off-state. In the example in FIG. 2, when the first DIP switch and the second DIP switch are both in an off-state, the operating mode is set to normal operation to solely operate the air conditioner 2. The normal operation corresponds to the first operating mode. A target operating device for the normal operation is the air conditioner 2. The air conditioner 2 has cooling, drying, air-blowing, and heating functions.

In the example illustrated in FIG. 2, when the first DIP switch is in an on-state while the second DIP switch is in an off-state, the operating mode is set to first special operation to enable the air conditioner 2 and the external device 5 to operate simultaneously. The first special operation corresponds to an example of the second operating mode. Target operating devices for the first special operation are the air conditioner 2 and the external device 5. The air conditioner 2 performs cooling, drying, and air-blowing. The external device 5 performs heating.

In the example illustrated in FIG. 2, when the first DIP switch is in an off-state while the second DIP switch is in an on-state, the operating mode is set to second special operation to enable the air conditioner 2 and the external device 5 to operate simultaneously. The second special operation corresponds to another example of the second operating mode. Target operating devices for the second special operation are the air conditioner 2 and the external device 5. The air conditioner 2 performs cooling, drying, air-blowing, and heating, and the external device 5 performs heating.

Either one of the first operating mode to solely operate the air conditioner 2 and the second operating mode to enable the air conditioner 2 and the external device 5 to operate simultaneously may not be given to the DIP switch group 11. It is allowable that either one of the first operating mode and the second operating mode is given to the manipulation terminal 3 by a user. In this case, the manipulation terminal 3 transmits to the interface 1 information indicating an operating mode given by a user, that is either the first operating mode or the second operating mode. The manipulation-terminal communication unit 9 then receives the information, and the control unit 6 stores the information received by the manipulation-terminal communication unit 9 in the storage unit 12. In this case, the control unit 6 reads the information stored in the storage unit 12.

For example, when the interface 1 is reactivated by power reset, the control unit 6 determines whether the control unit 6 has read the information indicating the operating mode given to the DIP switch group 11 or has read the information stored in the storage unit 12 before the power reset. When the control unit 6 has read the information given to the DIP switch group 11 before the power reset, the control unit 6 reads the information given to the DIP switch group 11 after the power reset. When the control unit 6 has read the instruction stored in the storage unit 12 before the power reset, the control unit 6 reads the information stored in the storage unit 12 after the power reset. Due to this reading, the interface 1 returns to the previous operation prior to the power reset.

It is allowable that the manipulation terminal 3 cancels the operating mode given to the manipulation terminal 3, and follows the operating mode given to the DIP switch group 11.

The control unit 6 has a function of setting the running designated from the manipulation terminal 3 for the air conditioner 2 through the data conversion unit 8 and the air-conditioner communication unit 7.

The air conditioner 2 measures a room temperature that is the temperature inside the room where the air conditioner 2 is installed. The manipulation terminal 3 also measures the room temperature. An instruction indicating whether the control unit 6 obtains the information indicating the room temperature from the air conditioner 2 or the manipulation terminal 3 is also given to the DIP switch group 11. In accordance with the instruction given to the DIP switch group 11, the control unit 6 obtains the information indicating the room temperature from the air conditioner 2 or the manipulation terminal 3.

When the air conditioner 2 stops during heating as in the first special operation illustrated in FIG. 2, a fan of the air conditioner 2 does not rotate and thus heat stays. Accordingly, the air conditioner 2 may possibly measure a room temperature that is higher than the actual room temperature. For this reason, when the air conditioner 2 stops during heating as in the first special operation, it is allowable to switch the device that measures the room temperature from the air conditioner 2 to the manipulation terminal 3.

The external device 5 operates when the external device 5 is connected to the interface 1 through the relay 4. However, it is allowable that the external device 5 operates when the interface 1 and the external device 5 both include a wireless device so that information is wirelessly shared between the interface 1 and the external device 5. In this case, it is allowable that the interface 1 and the external device 5 operate on the basis of information transmitted from the manipulation terminal 3. The wireless device described above is a device having a function of performing wireless communication via Wi-Fi (registered trademark) or Bluetooth (registered trademark).

Figure 3:
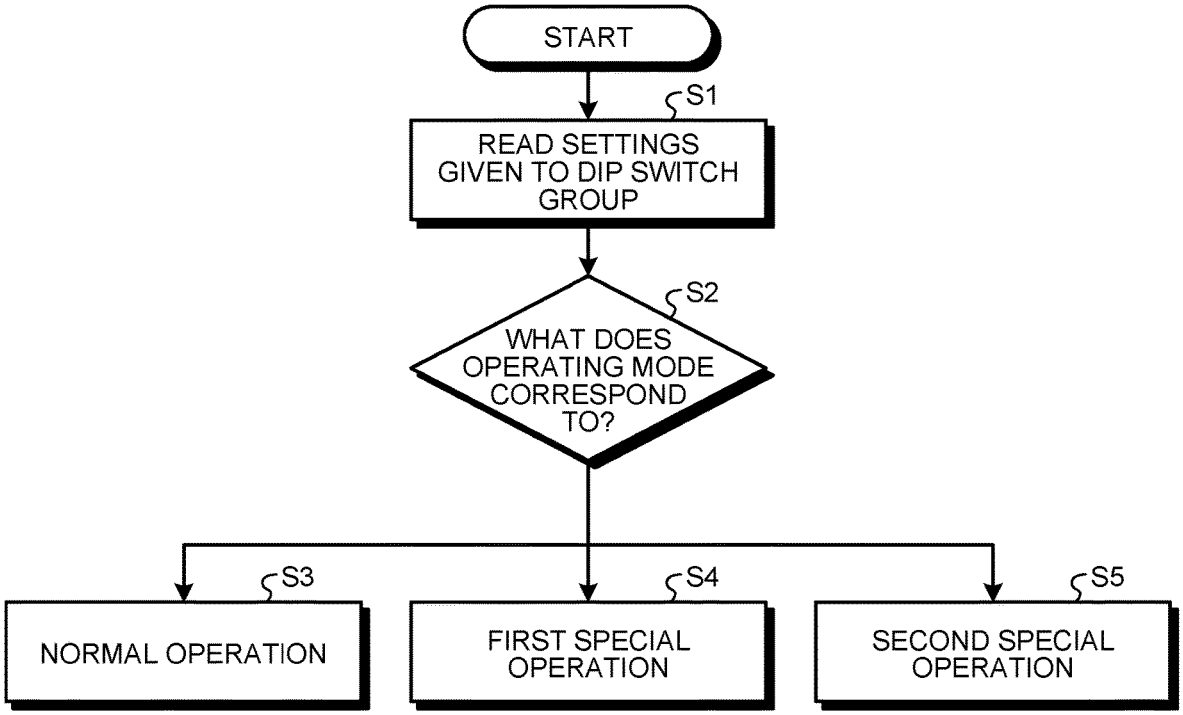
FIG. 3 is a flowchart illustrating an example of an operating procedure for the air conditioner interface according to the embodiment.

FIG. 3 is a flowchart illustrating an example of the operating procedure for the air conditioner interface 1 according to the embodiment. The control unit 6 reads information indicating settings given to the DIP switch group 11 when the interface 1 is activated (S1). The settings include an operating mode. The control unit 6 determines the operating mode indicated by the read information (S2).

When the control unit 6 determines that an operating mode, indicated by the information read at Step S1, corresponds to normal operation, the control unit 6 executes a control for the normal operation (S3). When the control unit 6 determines that the operating mode corresponds to first special operation, the control unit 6 executes a control for the first special operation (S4). When the control unit 6 determines that the operating mode corresponds to second special operation, the control unit 6 executes a control for the second special operation (S5).

Figure 4:
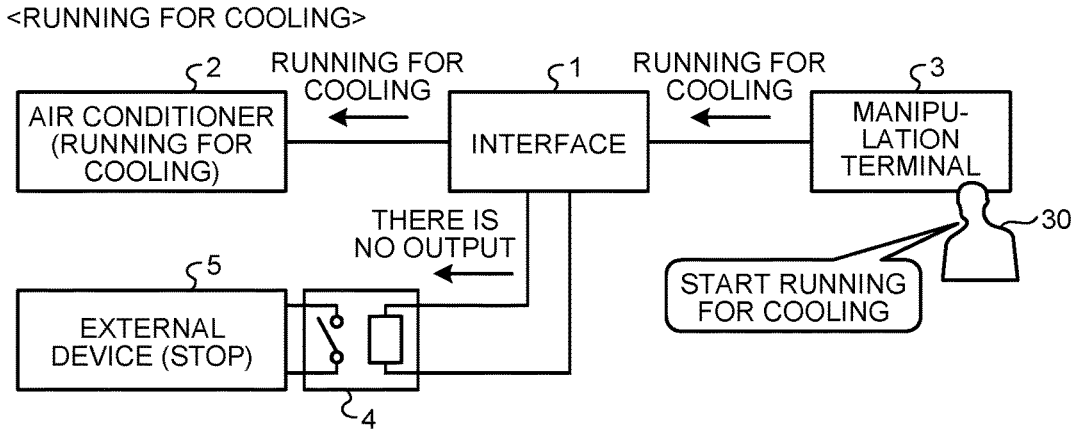
FIG. 4 is a first diagram illustrating an example of operation of an air-conditioning system when an operating mode set for the air conditioner interface according to the embodiment corresponds to a first special operation.

FIG. 4 is a first diagram illustrating an example of operation of an air-conditioning system when the operating mode set for the air conditioner interface 1 according to the embodiment corresponds to the first special operation. The air-conditioning system includes the interface 1, the air conditioner 2, the manipulation terminal 3, the relay 4, and the external device 5. The air conditioner 2, the manipulation terminal 3, and the relay 4 are assumed to be connected to the interface 1.

When a user 30 manipulates the manipulation terminal 3 so as to start running for cooling, the manipulation terminal 3 transmits an instruction to start running for cooling to the interface 1. In FIG. 4, the manipulation terminal 3 transmits the instruction described as "running for cooling" to the interface 1. The interface 1 transmits the instruction to start running for cooling to the air conditioner 2. In FIG. 4, the interface 1 transmits the instruction described as "running for cooling" to the air conditioner 2. The interface 1 does not output any instruction to the relay 4.

The air conditioner 2 runs for cooling in accordance with the instruction transmitted from the interface 1. Because the interface 1 does not output any instruction to the relay 4, the relay 4 is opened and does not connect the interface 1 to the external device 5. The external device 5 stops.

When the user 30 manipulates the manipulation terminal 3 so as to start running for drying or running for air-blowing, the air-conditioning system performs the same operation as that when the user 30 manipulates the manipulation terminal 3 so as to start running for cooling. However, running for cooling is replaced with running for drying or running for air-blowing.

Figure 5:
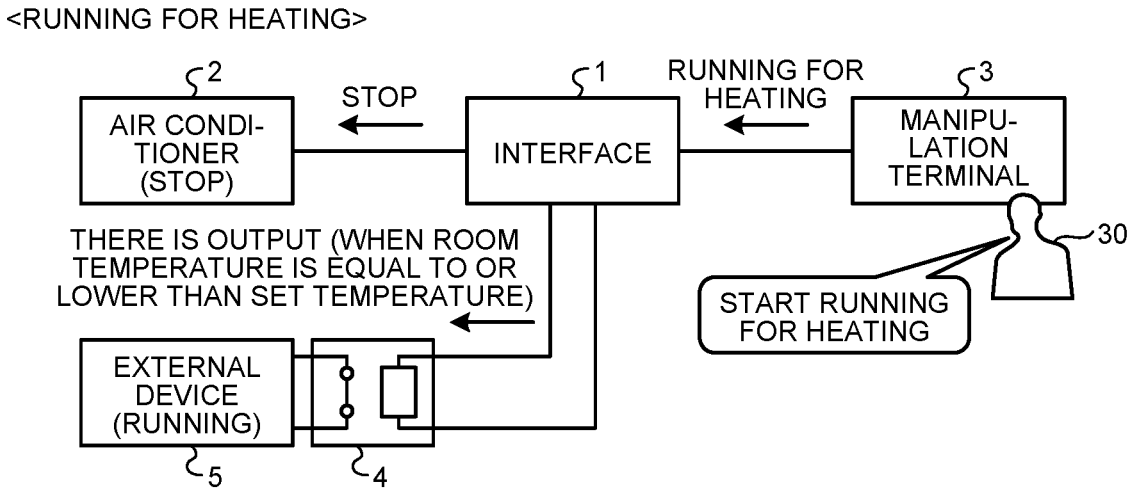
FIG. 5 is a second diagram illustrating an example of operation of the air-conditioning system when the operating mode set for the air conditioner interface according to the embodiment corresponds to the first special operation.

FIG. 5 is a second diagram illustrating an example of operation of the air-conditioning system when the operating mode set for the air conditioner interface 1 according to the embodiment corresponds to the first special operation. When the user 30 manipulates the manipulation terminal 3 so as to start running for heating, the manipulation terminal 3 transmits an instruction to start running for heating to the interface 1. In FIG. 5, the manipulation terminal 3 transmits the instruction described as "running for heating" to the interface 1.

The interface 1 transmits an instruction to stop running to the air conditioner 2. When the room temperature is equal to or lower than a set temperature, the interface 1 outputs an instruction for starting running for heating to the relay 4. The set temperature is set for the interface 1 through the manipulation terminal 3. In accordance with the instruction for starting running for heating, the relay 4 is closed to thereby connect the interface 1 to the external device 5. The external device 5 runs for heating.

Figure 6:
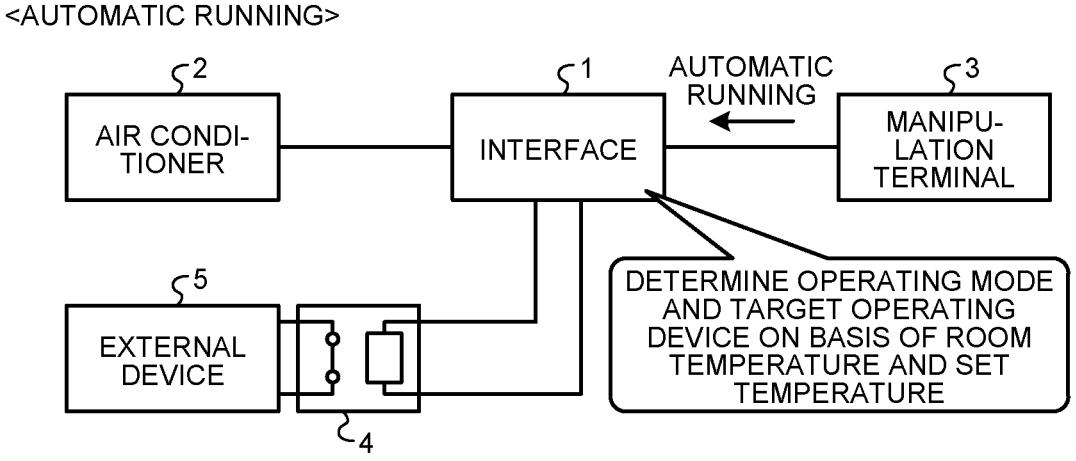
FIG. 6 is a third diagram illustrating an example of operation of the air-conditioning system when the operating mode set for the air conditioner interface according to the embodiment corresponds to the first special operation.

FIG. 6 is a third diagram illustrating an example of operation of the air-conditioning system when the operating mode set for the air conditioner interface 1 according to the embodiment corresponds to the first special operation. When the manipulation terminal 3 is not manipulated by the user 30, the manipulation terminal 3 transmits an instruction to start automatic running to the interface 1. In FIG. 6, the manipulation terminal 3 transmits the instruction described as "automatic running" to the interface 1.

The interface 1 obtains information indicating the room temperature from the air conditioner 2 or the manipulation terminal 3, and compares the obtained room temperature with a set temperature that is set by the manipulation terminal 3. In accordance with a result of the comparison, the interface 1 determines the operating mode and the target operating device, and then performs operation so as to start running for cooling or running for heating. When there is a change in one or both of the room temperature and the set temperature, the interface 1 performs operation in response to the change.

Figure 7:
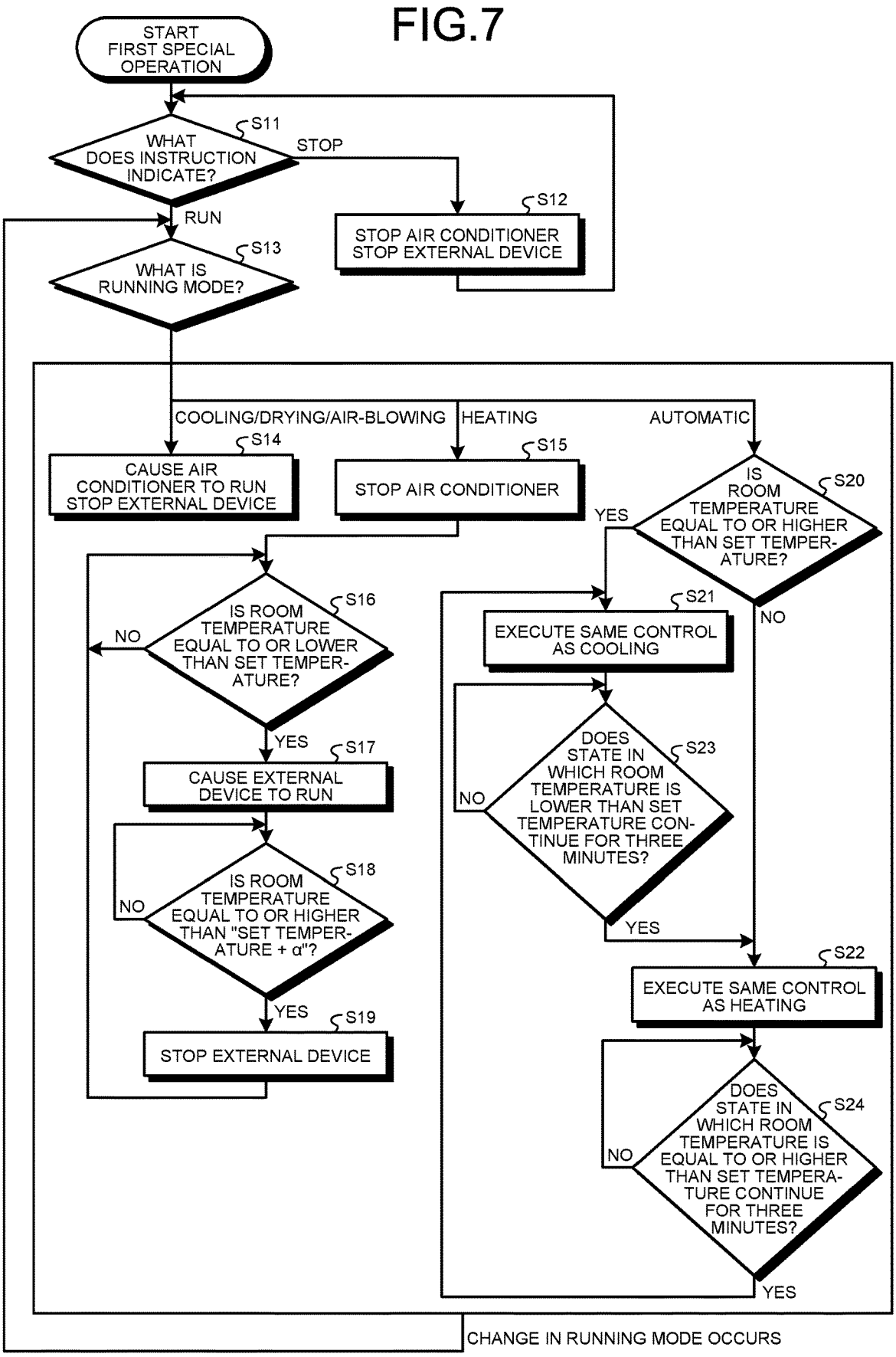
FIG. 7 is a flowchart illustrating a first operating procedure for the air conditioner interface according to the embodiment.

FIG. 7 is a flowchart illustrating a first operating procedure for the air conditioner interface 1 according to the embodiment. Specifically, FIG. 7 illustrates the operating procedure for the interface 1 in the first special operation.

The control unit 6 in the interface 1 checks for an instruction indicating whether to cause a target operating device to run (S11). For example, the instruction is transmitted from the manipulation terminal 3 to the interface 1. When the control unit 6 checks that the instruction indicates that the control unit 6 stops a target operating device (stop at S11), the control unit 6 stops both the air conditioner 2 and the external device 5 (S12). After having performed operation at Step S12, the control unit 6 performs operation at Step S11 again.

When the control unit 6 checks that the instruction indicates that the control unit 6 causes a target operating device to run (run at S11), the control unit 6 checks for the running mode (S13). For example, information indicating the running mode is transmitted from the manipulation terminal 3 to the interface 1. When the control unit 6 checks that the running mode is a cooling/drying/air-blowing mode (cooling/drying/air-blowing at S13), the control unit 6 causes the air conditioner 2 to run for cooling, drying, or air-blowing, and stops the external device 5 (S14). The cooling/drying/air-blowing mode is any of the cooling mode, the drying mode, and the air-blowing mode.

When the control unit 6 checks that the running mode is the heating mode (heating at S13), the control unit 6 stops the air conditioner 2 (S15). The control unit 6 determines whether a room temperature that is the temperature inside the room where the air conditioner 2 is installed is equal to or lower than a set temperature (S16). When the control unit 6 determines that the room temperature is higher than the set temperature (NO at S16), the control unit 6 performs operation at Step S16 again.

When the control unit 6 determines that the room temperature is equal to or lower than the set temperature (YES at S16), the control unit 6 closes the relay 4 to cause the external device 5 to run (S17). After having caused the external device 5 to run, the control unit 6 determines whether the room temperature is equal to or higher than a temperature obtained by adding a degrees to the set temperature (S18). $\alpha$ is a positive value. In the following descriptions, the temperature obtained by adding a degrees to the set temperature is described as "set temperature+$\alpha$". When the control unit 6 determines that the room temperature is lower than "set temperature+$\alpha$" (NO at S18), the control unit 6 performs operation at Step S18 again. When the control unit 6 determines that the room temperature is equal to or higher than "set temperature+$\alpha$" (YES at S18), the control unit 6 opens the relay 4 to stop the external device 5 (S19). After having performed operation at Step S19, the control unit 6 performs operation at Step S16.

When the control unit 6 checks that the running mode is the automatic mode (automatic at S13), the control unit 6 determines whether the room temperature is equal to or higher than a set temperature (S20). When the control unit 6 determines that the room temperature is equal to or higher than the set temperature (YES at S20), the control unit 6 executes the same control as that in the cooling mode (S21). When the control unit 6 determines that the room temperature is lower than the set temperature (NO at S20), the control unit 6 executes the same control as that in the heating mode (S22).

After having performed operation at Step S21, the control unit 6 determines whether a state in which the room temperature is lower than the set temperature continues for three minutes (S23). When the control unit 6 determines that the state in which the room temperature is lower than the set temperature continues for three minutes (YES at S23), the control unit 6 performs operation at Step S22. When the control unit 6 determines that the state in which the room temperature is lower than the set temperature does not continue for three minutes (NO at S23), the control unit 6 performs operation at Step S23 again.

After having performed operation at Step S22, the control unit 6 determines whether a state in which the room temperature is equal to or higher than the set temperature continues for three minutes (S24). When the control unit 6 determines that the state in which the room temperature is equal to or higher than the set temperature continues for three minutes (YES at S24), the control unit 6 performs operation at Step S21. When the control unit 6 determines that the state in which the room temperature is equal to or higher than the set temperature does not continue for three minutes (NO at S24), the control unit 6 performs operation at Step S24 again.

In a case where the air conditioner 2 runs in any of plural running modes, when the control unit 6 receives an instruction to change the running mode from the manipulation terminal 3, the control unit 6 performs operation at Step S13 again. In FIG. 7, the instruction to change the running mode is expressed by the words "CHANGE IN RUNNING MODE OCCURS".

In the above descriptions with reference to FIG. 7, in a case where the running mode is the heating mode, when the control unit 6 determines that the room temperature is equal to or lower than the set temperature (YES at S16), the control unit 6 causes the external device 5 to run (S17). That is, the running condition of the external device 5 is that the room temperature is equal to or lower than the set temperature. However, the running condition of the external device 5 is not limited to the condition that the room temperature is equal to or lower than the set temperature, but may be set in accordance with an instruction from the manipulation terminal 3.

In the above descriptions with reference to FIG. 7, in a case where the running mode is the automatic mode, the control unit 6 determines whether the room temperature is equal to or higher than the set temperature at Step S20, and executes the same control as that in the cooling mode or the heating mode in accordance with a result of the determination (S21 and S22). That is, the control unit 6 executes the same control as that in the cooling mode on the condition that the room temperature is equal to or higher than the set temperature. However, the condition for the control unit 6 to execute the same control as that in the cooling mode when the running mode is the automatic mode is not limited to the condition that the room temperature is equal to or higher than the set temperature, but may be set in accordance with an instruction from the manipulation terminal 3. In addition, the time period of "three minutes" described above in the running mode is merely an example, and may be changed in accordance with an instruction from the manipulation terminal 3.

The air conditioner 2 in the above descriptions with reference to FIG. 7 may be a device that does not have a function of running for heating, but has functions of running for cooling, running for drying, and running for air-blowing. The air conditioner 2 may also be a device having a function of only running for cooling.

The air-conditioner communication unit 7 in the interface 1 receives device-type information on the air conditioner 2 from the air conditioner 2. When the air conditioner 2 is not a device that supports the automatic mode, the data conversion unit 8 in the interface 1 changes the device-type information to device-type information including information indicating that the air conditioner 2 supports the automatic mode. The manipulation-terminal communication unit 9 in the interface 1 transmits the device-type information having been changed to the manipulation terminal 3. The manipulation terminal 3 forms a manipulation screen on the basis of the device-type information on the air conditioner 2 transmitted from the interface 1.

As described above, even when the air conditioner 2 is not a device that supports the automatic mode, the interface 1 still transmits to the manipulation terminal 3 the device-type information including information indicating that the air conditioner 2 supports the automatic mode. Due to this information, even when the air conditioner 2 is not a device that supports the automatic mode, the manipulation terminal 3 can still switch the running mode from the cooling/drying/air-blowing mode or from the heating mode to the automatic mode for the interface 1.

Figure 8:
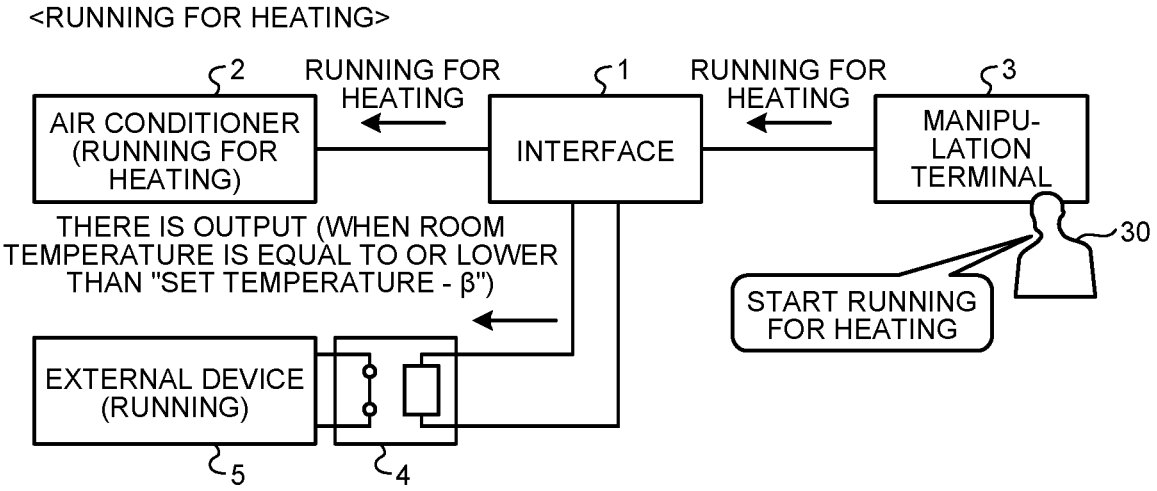
FIG. 8 is a diagram illustrating an example of operation of the air-conditioning system when the operating mode set for the air conditioner interface according to the embodiment corresponds to a second special operation.

FIG. 8 is a diagram illustrating an example of operation of the air-conditioning system when the operating mode set for the air conditioner interface 1 according to the embodiment corresponds to the second special operation. When the user 30 manipulates the manipulation terminal 3 so as to start running for heating, the manipulation terminal 3 transmits an instruction to start running for heating to the interface 1. In FIG. 8, the manipulation terminal 3 transmits an instruction described as "running for heating" to the interface 1.

The interface 1 transmits an instruction to start running for heating to the air conditioner 2. In FIG. 8, the interface 1 transmits the instruction described as "running for heating" to the air conditioner 2. The air conditioner 2 runs for heating. When the room temperature is equal to or lower than "set temperature−β", the interface 1 outputs an instruction for starting running for heating to the relay 4. In accordance with the instruction for starting running for heating, the relay 4 is closed to thereby connect the interface 1 to the external device 5. The external device 5 runs for heating.

Figure 9:
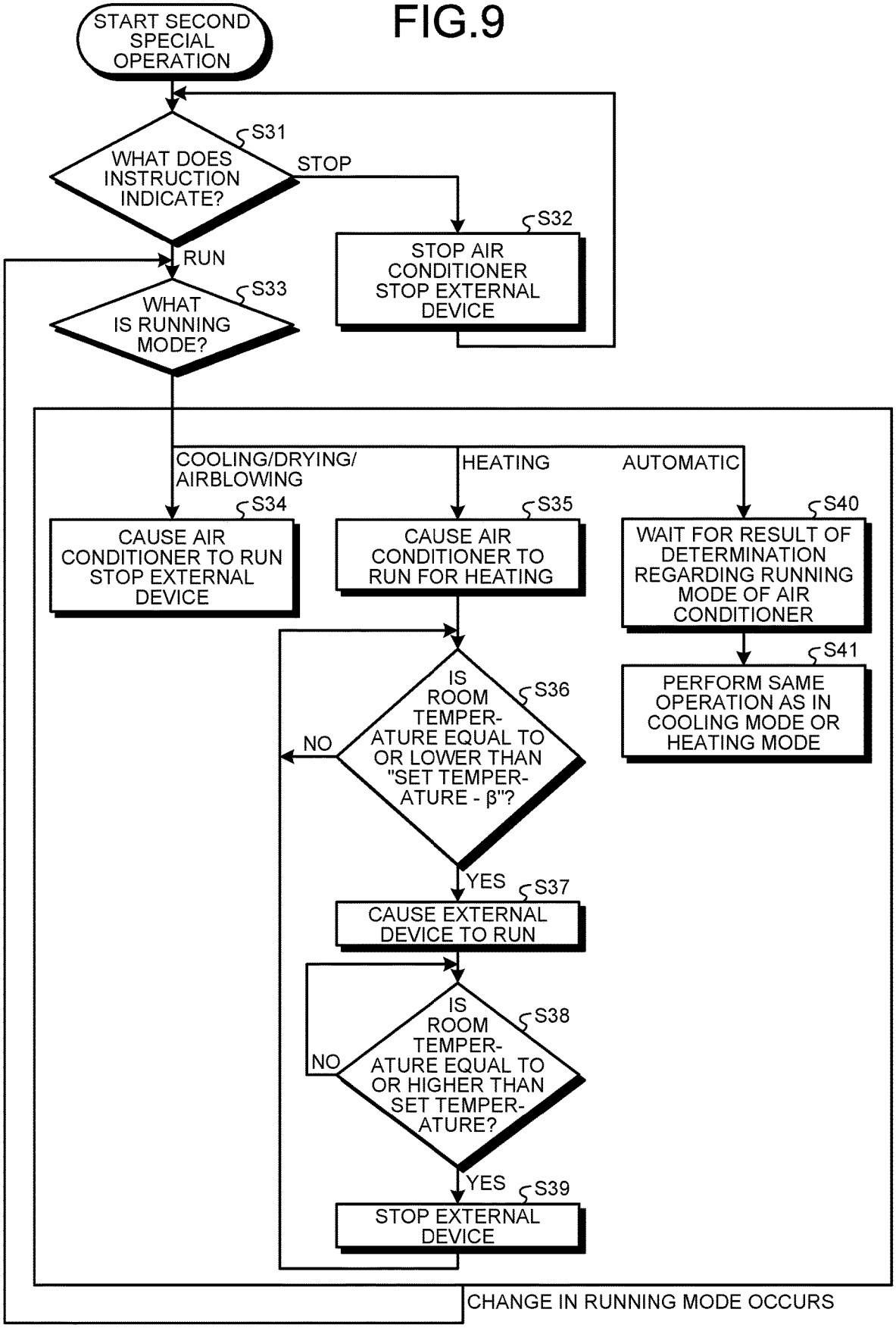
FIG. 9 is a flowchart illustrating a second operating procedure for the air conditioner interface according to the embodiment.

FIG. 9 is a flowchart illustrating a second operating procedure for the air conditioner interface 1 according to the embodiment. Specifically, FIG. 9 illustrates the operating procedure for the interface 1 in the second special operation.

The control unit 6 in the interface 1 checks for an instruction indicating whether to cause a target operating device to run (S31). When the control unit 6 checks that the instruction indicates that the control unit 6 stops a target operating device (stop at S31), the control unit 6 stops both the air conditioner 2 and the external device 5 (S32). After having performed operation at Step S32, the control unit 6 performs operation at Step S31 again.

When the control unit 6 checks that the instruction indicates that the control unit 6 causes a target operating device to run (run at S31), the control unit 6 checks for the running mode (S33). When the control unit 6 checks that the running mode is a cooling/drying/air-blowing mode (cooling/drying/air-blowing at S33), the control unit 6 causes the air conditioner 2 to run for cooling, drying, or air-blowing, and stops the external device 5 (S34).

When the control unit 6 checks that the running mode is the heating mode (heating at S33), the control unit 6 causes the air conditioner 2 to run for heating (S35). The control unit 6 determines whether the room temperature is equal to or lower than a temperature obtained by subtracting β degrees from the set temperature (S36). β is a positive value. In the following descriptions, the temperature obtained by subtracting β degrees from the set temperature is described as "set temperature−β". When the control unit 6 determines that the room temperature is higher than "set temperature−β" (NO at S36), the control unit 6 performs operation at Step S36 again. When the control unit 6 determines that the room temperature is equal to or lower than "set temperature−β" (YES at S36), the control unit 6 causes the external device 5 to run (S37).

After having caused the external device 5 to run, the control unit 6 determines whether the room temperature is equal to or higher than the set temperature (S38). When the control unit 6 determines that the room temperature is lower than the set temperature (NO at S38), the control unit 6 performs operation at Step S38 again. When the control unit 6 determines that the room temperature is equal to or higher than the set temperature (YES at S38), the control unit 6 opens the relay 4 to stop the external device 5 (S39). When the control unit 6 performs operation at Step S39, the control unit 6 causes the air conditioner 2 to run for heating. After having performed operation at Step S39, the control unit 6 performs operation at Step S36.

When the control unit 6 checks that the running mode is the automatic mode (automatic at S33), the control unit 6 waits for a result of a determination regarding whether the air conditioner 2 performs the same operation as either automatic cooling or automatic heating (S40). The air-conditioner communication unit 7 in the interface 1 receives data indicating whether the air conditioner 2 performs automatic cooling or automatic heating from the air conditioner 2, while the control unit 6 performs the same operation as that when the running mode is the cooling mode or the heating mode in accordance with the data received by the air-conditioner communication unit 7 (S41).

In a case where the air conditioner 2 runs in any of plural running modes, when the control unit 6 receives an instruction to change the running mode from the manipulation terminal 3, the control unit 6 performs operation at Step S33 again. In FIG. 9, the instruction to change the running mode is expressed by the words "CHANGE IN RUNNING MODE OCCURS".

In the embodiment described above, the interface 1 controls operation of the air conditioner 2 and operation of the external device 5 on the basis of an operating mode given to the DIP switch group 11, or on the basis of an operating mode indicated by information transmitted from the manipulation terminal 3 to the interface 1. That is, the interface 1 can make it possible for the air conditioner 2 and the external device 5 to operate in conjunction with each other even though both the air conditioner 2 and the external device 5 do not have means for being able to directly communicate with their counterpart.

The interface 1 operates in accordance with the above operating mode and running mode. That is, the interface 1 causes a target operating device to run in accordance with the operating mode and the running mode. Even when the existing air conditioner 2, manipulation terminal 3, and external device 5 are used, the interface 1 can still control running and stop of the air conditioner 2 and the external device 5 in accordance with the operating mode and the running mode, so that the interface 1 can operate the air conditioner 2 and the external device 5 in conjunction with each other.

As described above, when the second operating mode is set for the interface 1, the control unit 6 determines a target operating device from among the air conditioner 2 and the external device 5 in accordance with a running mode instructed from the manipulation terminal 3. The control unit 6 then operates the determined target operating device. Thus, the interface 1 can use the manipulation terminal 3 for controlling operation of the external device 5, the manipulation terminal 3 being used by a user to manipulate the air conditioner 2.

As described above, in a case where the control unit 6 determines a target operating device, when the running mode is the automatic mode, the control unit 6 determines either one of the cooling mode and the heating mode as the running mode on the basis of a relation between a set temperature and a room temperature that is the temperature inside the room where the air conditioner 2 is installed, and then the control unit 6 determines the target operating device in accordance with the determined mode. Due to this determination, the interface 1 can minimize an increase in the number of times of manipulating the air conditioner 2 by a user.

When the room temperature is lower than "set temperature−β", the interface 1 causes both the air conditioner 2 and the external device 5 to run for heating, and thus can increase the room temperature for a shorter time as compared to the case when only the air conditioner 2 runs for heating.

The operating mode illustrated in FIG. 2 is merely an example. In the above embodiment, the external device 5 is assumed to be a heater. However, the external device 5 may be a device other than the heater. For example, it is allowable that the external device 5 is an air cleaner, a dehumidifier, or a humidifier. It is allowable that a plurality of external devices 5 are connected to the interface 1. For example, it is allowable that some or all of the air cleaner, the dehumidifier, and the humidifier, along with the air conditioner 2 and the external device 5, are connected to the interface 1. In this case, it is allowable that the interface 1 operates the air conditioner 2 and the air cleaner simultaneously.

Figure 10:
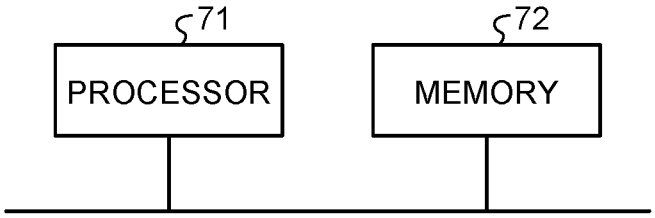
FIG. 10 is a diagram illustrating a processor in a case where at least some of the functions of a control unit, an air-conditioner communication unit, a data conversion unit, a manipulation-terminal communication unit, and a display unit, which are included in the air conditioner interface according to the embodiment, are implemented by the processor.

FIG. 10 is a diagram illustrating a processor 71 in a case where at least some of the functions of the control unit 6, the air-conditioner communication unit 7, the data conversion unit 8, the manipulation-terminal communication unit 9, and the display unit 10, which are included in the air conditioner interface 1 according to the embodiment, are implemented by the processor 71. That is, at least some of the functions of the control unit 6, the air-conditioner communication unit 7, the data conversion unit 8, the manipulation-terminal communication unit 9, and the display unit 10 may be implemented by the processor 71 that executes programs stored in a memory 72.

The processor 71 is a central processing unit (CPU), a processing device, an arithmetic device, a microprocessor, or a digital signal processor (DSP). The memory 72 is also illustrated in FIG. 10.

In a case where at least some of the functions of the control unit 6, the air-conditioner communication unit 7, the data conversion unit 8, the manipulation-terminal communication unit 9, and the display unit 10 are implemented by the processor 71, the at least some of the functions are implemented by the processor 71 and by software, firmware, or a combination of software and firmware. The software or firmware is described as programs and stored in the memory 72. The processor 71 reads and executes the programs stored in the memory 72 to implement at least some of the functions of the control unit 6, the air-conditioner communication unit 7, the data conversion unit 8, the manipulation-terminal communication unit 9, and the display unit 10.

That is, in a case where at least some of the functions of the control unit 6, the air-conditioner communication unit 7, the data conversion unit 8, the manipulation-terminal communication unit 9, and the display unit 10 are implemented by the processor 71, the interface 1 includes the memory 72 for storing programs with which steps executed by at least some of the control unit 6, the air-conditioner communication unit 7, the data conversion unit 8, the manipulation-terminal communication unit 9, and the display unit 10 are executed as a result.

The programs stored in the memory 72 are also regarded as programs causing a computer to execute the procedure or method conducted by at least some of the control unit 6, the air-conditioner communication unit 7, the data conversion unit 8, the manipulation-terminal communication unit 9, and the display unit 10.

The memory 72 is, for example, a nonvolatile or volatile semiconductor memory such as a random access memory (RAM), a read only memory (ROM), a flash memory, an erasable programmable read only memory (EPROM), or an EEPROM (registered trademark); a magnetic disk; a flexible disk; an optical disk, a compact disk; a mini disk, a digital versatile disk (DVD) or the like.

Figure 11:
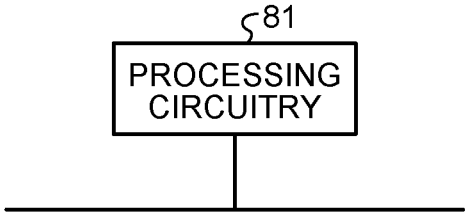
FIG. 11 is a diagram illustrating a processing circuitry in a case where at least some of the control unit, the air-conditioner communication unit, the data conversion unit, the manipulation-terminal communication unit, and the display unit, which are included in the air conditioner interface according to the embodiment, are implemented by the processing circuitry.

FIG. 11 is a diagram illustrating a processing circuitry 81 in a case where at least some of the control unit 6, the air-conditioner communication unit 7, the data conversion unit 8, the manipulation-terminal communication unit 9, and the display unit 10, which are included in the air conditioner interface 1 according to the embodiment, are implemented by the processing circuitry 81. That is, it is allowable that at least some of the control unit 6, the air-conditioner communication unit 7, the data conversion unit 8, the manipulation-terminal communication unit 9, and the display unit 10 are implemented by the processing circuitry 81.

The processing circuitry 81 is dedicated hardware. The processing circuitry 81 is, for example, a single circuit, a composite circuit, a programmed processor, a parallel-programmed processor, an application specific integrated circuit (ASIC), an field-programmable gate array (FPGA), or a combination of these elements.

At least some of the control unit 6, the air-conditioner communication unit 7, the data conversion unit 8, the manipulation-terminal communication unit 9, and the display unit 10 may be dedicated hardware that is independent from the rest of these elements.

As for a plurality of functions of the control unit 6, the air-conditioner communication unit 7, the data conversion unit 8, the manipulation-terminal communication unit 9, and the display unit 10, it is allowable that some of these functions are implemented by software or firmware, and the rest of these functions are implemented by dedicated hardware. In this manner, these of functions of the control unit 6, the air-conditioner communication unit 7, the data conversion unit 8, the manipulation-terminal communication unit 9, and the display unit 10 may be implemented by hardware, software, firmware, or a combination of these elements.

The configurations described in the above embodiment are only examples of the content of the present invention. The configurations can be combined with other well-known techniques, and part of each of the configurations can be omitted or modified without departing from the scope of the present invention.

The invention claimed is:

1. An air conditioner interface to which an air conditioner, a manipulation terminal, and an external device are connected, the manipulation terminal being used by a user to manipulate the air conditioner, the external device having an air-conditioning function, the air conditioner interface comprising a controlling circuitry to control operation of the air conditioner and operation of the external device in accordance with an operating mode that is set to either a first operating mode to solely operate the air conditioner or a second operating mode to enable the air conditioner and the external device to operate simultaneously, wherein when the second operating mode is set, the controlling circuitry determines a target operating device from among the air conditioner and the external device in accordance with a running mode for air conditioning instructed from the manipulation terminal, and then operates the target operating device determined, and the running mode is any one of a cooling mode, a drying mode, an air-blowing mode, and a heating mode.

2. The air conditioner interface according to claim 1, wherein when the controlling circuitry determines the target operating device, and when the running mode is an automatic mode, the controlling circuitry determines either one of a cooling mode and a heating mode as the running mode on a basis of a relation between a set temperature and a room temperature that is a temperature inside a room where the air conditioner is installed, and determines the target operating device in accordance with a determined mode.

3. The air conditioner interface according to claim 2, further comprising:

an air-conditioner communicating circuitry to receive information from the air conditioner;

a data converting circuitry to convert the information received by the air-conditioner communicating circuitry to information corresponding to the automatic mode when the air conditioner is not a device that supports the automatic mode; and a manipulation-terminal communicating circuitry to transmit the information obtained by the data converting circuitry to the manipulation terminal.

* * * * *